US006837122B2

(12) United States Patent
Herrmann et al.

(10) Patent No.: US 6,837,122 B2
(45) Date of Patent: Jan. 4, 2005

(54) DEVICE AND METHOD FOR DETECTING THE MASS AND THE MOISTURE CONTENT FOR SPINNING PREPARATION MACHINES

(75) Inventors: Rainer Herrmann, Hamburg (DE); Manfred Tews, Hamburg (DE); Udo Schlemm, Hamburg (DE)

(73) Assignee: TEWS Elektronik, Hamburg (DE)

( * ) Notice: Subject to any disclaimer, the term of this patent is extended or adjusted under 35 U.S.C. 154(b) by 0 days.

(21) Appl. No.: 10/305,997

(22) Filed: Nov. 26, 2002

(65) Prior Publication Data

US 2003/0097830 A1 May 29, 2003

(30) Foreign Application Priority Data

Nov. 28, 2001 (DE) ..... 201 19 344 U
Mar. 13, 2002 (EP) ..... 02005752

(51) Int. Cl.[7] ..... G01N 25/56; G01R 23/02

(52) U.S. Cl. ..... 73/865; 73/73; 73/866; 324/633; 324/634; 324/636; 324/637; 324/640

(58) Field of Search ..... 73/73, 426, 43, 73/2.1, 865; 324/633, 634, 636, 637, 640

(56) References Cited

U.S. PATENT DOCUMENTS 4,155,035 A * 5/1979 Fitzky ..... 324/636
4,481,820 A 11/1984 Thomann
4,819,301 A 4/1989 Konig
4,899,100 A * 2/1990 Talanker et al. ..... 324/636
4,962,569 A 10/1990 Hosel
4,974,296 A 12/1990 Vidler
5,397,993 A * 3/1995 Tews et al. ..... 324/634
5,554,935 A * 9/1996 Kraszewski et al. ..... 324/637
5,864,239 A 1/1999 Adams et al.
5,977,780 A * 11/1999 Herrmann ..... 324/640
6,163,158 A * 12/2000 Moeller et al. ..... 324/633
6,452,404 B2 * 9/2002 Moeller et al. ..... 324/633
6,476,619 B1 * 11/2002 Moshe et al. ..... 324/634
2001/0030543 A1 10/2001 Joshi et al.

FOREIGN PATENT DOCUMENTS

| | | |
|---|---|---|
| DE | 39 27 394 | 2/1991 |
| EP | 0 669 522 | 8/1995 |
| WO | WO 00/28615 | 5/2000 |

* cited by examiner

*Primary Examiner*—Hezron Williams
*Assistant Examiner*—David A. Rogers
(74) *Attorney, Agent, or Firm*—Alix, Yale & Ristas, LLP

(57) ABSTRACT

The device for measuring the mass and/or the moisture of a material running through a spinning preparation machine is distinguished in that it has a microwave resonator (15, 18) and associated adapted measurement electronics. The method for measuring the mass and/or the moisture of a material running through a spinning preparation machine is distinguished in that the measurement is carried out with the aid of microwaves.

13 Claims, 2 Drawing Sheets

DEVICE AND METHOD FOR DETECTING THE MASS AND THE MOISTURE CONTENT FOR SPINNING PREPARATION MACHINES

BACKGROUND OF THE INVENTION

The invention relates to a device and a method for measuring the mass and the moisture content of a material running through a spinning preparation machine. The invention also relates to a spinning preparation machine which is equipped with such a device. When "mass" is referred to here, this always means the mass per unit length.

In the spinning preparation process, first the raw material delivered in bale form is stripped off from the bale and, after cleaning and mixing, is fed to what is known as a card. There, the material is processed into fibre strands and is subsequently deposited in a cask-like container, what is known as a can. A plurality of such fibre strands are then combined and fed to a drawframe. Here, they are drawn with the aid of pairs of rollers, in order thereby to align the fibres in parallel and to obtain a correspondingly thinner strand which, in turn, is deposited in a can, in order then to be further processed later or elsewhere.

Throughout the entire spinning preparation process, it is advantageous to know the moisture content of the material, particularly during bale stripping. Process-accompanying moisture measurement has not been carried out hitherto. The check takes place in the form of random sampling and in a time-consuming way with the aid of gravimetric moisture measurement in the laboratory.

An essential parameter in the run through the drawframe is the drawing ratio. This can be changed by changing the speeds of successive pairs of rollers. The faster the following pair of rollers rotates in relation to a preceding pair, the more the material is drawn. If the fibre slivers have a relatively high mass on entry, the drawing ratio will be increased, in order to obtain an exit strand of always the same mass. The procedure is reversed when the fibre strands entering have a relatively low mass. It is therefore essential, at all events, to measure this mass before entry into the drawframe. Additional check measurements may also take place in these or downstream of these.

The check of the homogeneity of the fibre sliver mass is also necessary at the exit of the card. The control of the cards with a view to greater sliver homogeneity may be carried out with the aid of a process-accompanying measuring device for the sliver mass.

The measurement of the fibre sliver mass has hitherto being carried out by mechanical measuring means, for example by pairs of rollers which enclose the material strand between them and are pressed away from one another the more, the thicker this strand is. One problem, in this case, however, is the considerable speed at which these machines operate. Speeds of the material strands of up to 1000 m/min are typical here, this signifying speeds of approximately up to 17 m/sec. If changes in mass which extend over only a few centimetres of the strand are to be detected, therefore, the measuring means must have a time resolution of an order of magnitude of 1 msec or less. This can indeed be achieved somewhat satisfactorily by the mechanical means mentioned.

The disadvantage, however, is that an adverse influence is exerted on the material property by the mechanical frictional forces and by the material being pressed together. The thermal load leads to local heating or overheating, which can permanently damage the material.

The mechanical load leads to uneven distortions in the strand cross section. The structure, for example the degree of crimping, influences the measurement result (structural influence).

There is no process-accompanying measuring method for the moisture of the sliver material.

SUMMARY OF THE INVENTION

The object of the invention is, therefore, to provide a device and a method, by means of which the sliver mass and the material moisture can be measured reliably with a greater time resolution.

In one solution according to the invention, the device has a microwave resonator and associated adapted measurement electronics. A further solution according to the invention has a method in which the measurement is carried out by means of microwaves.

It is known to measure the mass and/or moisture of a material by means of microwave resonators (EP 0 468 023 B1). It is also possible to carry out such measurements not only where bulky materials are concerned, but also in the case of fast-running material strands. For this purpose, the running material strand is led through the microwave resonator. The mass per unit length of the material strand and, at the same time, its moisture content can be determined, in particular, by a measurement of the broadening of the resonance curve and the change in the resonant frequency of the microwave resonator due to the material running through.

The density measurement can be used, on the one hand, for controlling the homogenization of the fibre sliver masses in cards and drawframes. It may, however, also serve for communicating unusual operating situations and for switching on an alarm signal or stopping the machine. Moisture measurement in the region of bale stripping and also of the later processing steps can be used to reach a decision on the need for drying of the material. Other process parameters, too, such as, for example, drawing parameters are dependent on the material moisture.

The device according to the invention has proved highly advantageous for both measurement tasks. It can be used for a large number of fibrous materials which are processed in spinning preparation machines, such as, for example, wool, cotton and synthetic fibres.

The microwave resonator expediently has a passage orifice which surrounds the material strand. This always ensures that the entire material strand is located in the measurement range of the microwave resonator. In this type of microwave resonator, the material strand has to be threaded into the passage orifice and for this reason should not be continuous.

Measurement can be carried out on a continuous material strand when the microwave resonator has at least one slot-shaped orifice, into which the material strand is introduced from the side. If this slot-shaped orifice is sufficiently deep, even a plurality of material strands can run through the microwave resonator simultaneously.

It is particularly expedient, in this case, if the microwave resonator has two semi-cylindrical spaced-apart cavities, between which the at least one slot-shaped orifice is arranged.

For material in the region of bale stripping, which is not yet in sliver form, it is expedient to design the resonator as a planar stray-field sensor.

The resonator is expediently designed in such a way that it operates at microwave frequencies of approximately 300

MHz to approximately 30 GHz, in particular from approximately 1 to approximately 10 GHz.

The frequency used is in this case closely relates to the dimensions. It is perfectly possible to have a design such that the active measuring space has a length of the order of magnitude of 1 cm. At the abovementioned speeds of 6 to 14 m/sec, this means a time resolution of the order of magnitude of 1 msec, which gives results capable of being evaluated by electronic means. A spatial resolution of the order of magnitude of 1 cm is thus obtained.

Other forms of cavity resonators are likewise possible, as long as it is ensured that the measurement volume is constructed somewhat homogeneously, that is to say there are no pronounced fluctuations in the signals when the material strand moves within the measurement volume.

A spinning preparation machine according to the invention for bale stripping and/or for carding the material and/or for drawing the material is distinguished in that it has at least one microwave resonator for measuring the mass and/or the moisture of the material running through the machine.

Preferably, a microwave resonator can be used for determining the moisture of the raw material preferably in bale form and in each case is applied to the freshly combed surface of the bale of original material. Instead, the moisture sensor could also be provided, downstream of the bale, at the material conveyor which conveys the stripped material to the card.

Advantageously, a microwave resonator is provided after the carding means. It is thereby possible to detect the mass homogeneity of the material strands and therefore to carry out a regulation of the card.

Advantageously, a resonator is provided for fibre slivers which enter a drawframe, so that the drawing ratio can be set appropriately, in order to obtain at the exit a material strand with the desired draft and with the desired density/thickness. When a microwave resonator is provided in the drawframe, the measurement can be carried out nearer to the point where drawing actually takes place. If a microwave resonator is also provided at the exit of the drawframe, the effect of the drawing can be checked here.

A simultaneous measurement of the sliver speed is advantageous, since it is thus possible to determine the mass flow, that is to say the product of the mass and speed, even in the case of a variable sliver speed.

How the measurements are carried out in detail is a matter of expediency and also depends on how the spinning preparation machine is designed. Thus, for example, the individual fibre slivers which are combined could be measured individually or else together. The locations at which the density measurement is carried out may also be different, as was mentioned above.

BRIEF DESCRIPTION OF THE DRAWINGS

The invention is described below by means of an advantageous embodiment, with reference to the accompanying drawings in which, in a diagrammatic view.

DETAILED DESCRIPTION OF THE PREFERRED EMBODIMENT

Figure 1:
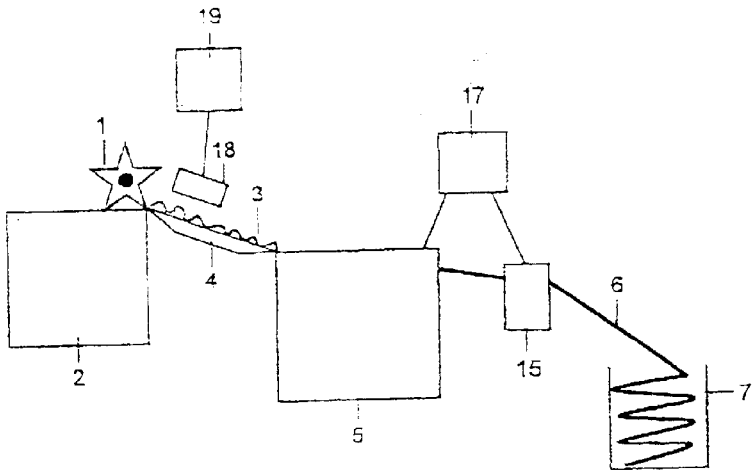
FIG. 1 shows the basic construction of a first part of a spinning preparation plant having the devices according to the invention.

As shown in FIG. 1, the fibrous material is stripped off from a bale 2 with the aid of a stripping means 1 and leaves the bale 2 as material 3 on a conveyor 4. After mixing and cleaning (not shown), which are not essential in this connection, the material is processed in a card 5 to form a fibre sliver 6 which is intermediately stored in a can 7.

Figure 2:
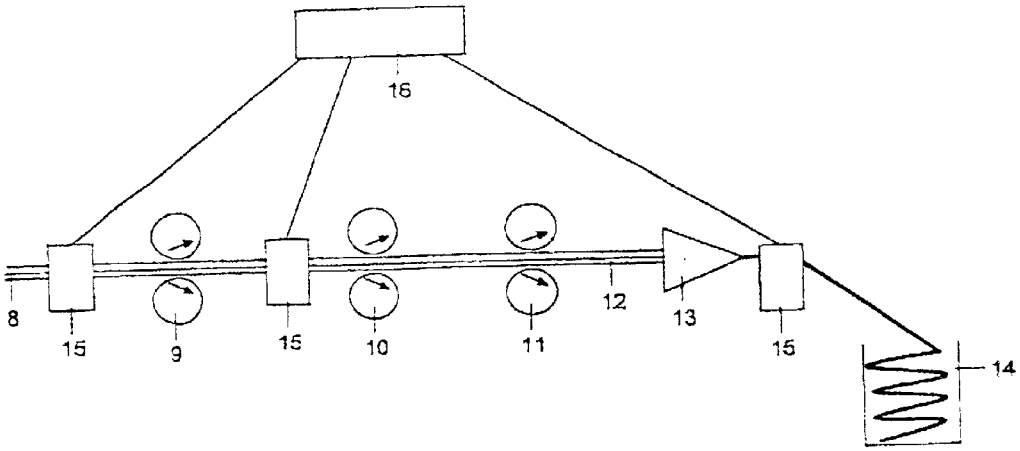
FIG. 2 shows the basic construction of a second part of a spinning preparation plant having the devices according to the invention.

As shown in FIG. 2, a plurality of fibre slivers 8 are fed to the drawframe from a plurality of cans 7 and run through pairs of rollers 9, 10, 11 (even more pairs of rollers may, of course, also be provided). The rotational speed of the pairs of rollers in this case increases in the direction of movement of the material strand, that is to say from left to right in FIG. 2, with the result that the fibre slivers 8 are processed into thinner material stands 12 by drawing and the fibres are parallelized. The fibre slivers 12 are combined in the sliver funnel 13 to a sliver and are deposited in a can 14, in order to be further processed later.

The masses of the fibre sliver 6 running out of the card, of the fibre slivers 8 running into the drawframe, of the slivers in the drawframe and of the strand running out of the drawframe can be measured with the aid of microwave resonators 15. The microwave resonators at the drawframe are in this case connected to adapted measurement electronics 16 by which the microwaves are generated and the changes in the resonant properties of the microwave resonators 15 are detected and then evaluated. Expediently, at least the microwave resonator 15 located on the left in FIG. 2 is provided upstream of the drawing means 9, 10, 11. The further microwave resonators 15 serve for a better check of the drawing operation. Depending on measurement by the microwave resonators 15, the electronic unit 16 also controls the drawing ratio, that is to say the speed ratios of the pairs of rollers 9, 10, 11.

The functioning of the card 5 is regulated correspondingly by the resonator 15 at the exit of the card 5 and by the associated control electronics 17.

FIG. 1 also shows a further microwave resonator 18 with an evaluation means 19. This microwave resonator serves for measuring the moisture of the material 3 stripped off from the bale 2, before entry into the card 5.

Figure 3:
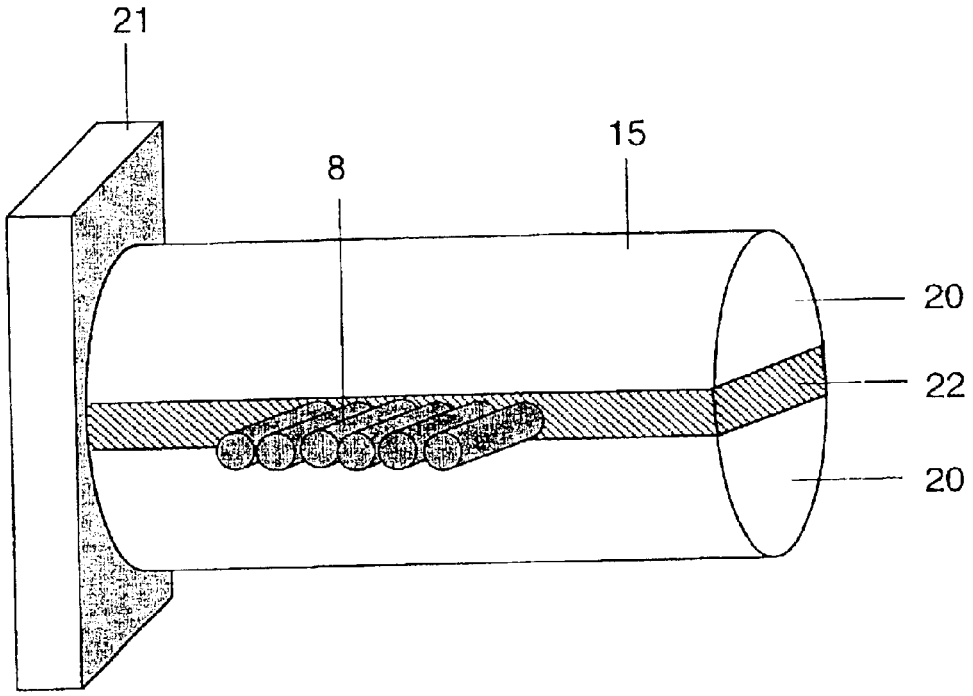
FIG. 3 shows a side view of a cavity resonator which is designed according to the invention.

FIG. 3 shows a microwave resonator 15 having two semi-cylindrical cavities 20 which are kept spaced apart by a holding means 21, so that they enclose between them a slot 22, into which the fibre slivers 8 are introduced.

Test measurements on fibre slivers in the spinning preparation process showed that measurement by microwave resonators has the following properties:

A simultaneous measurement of the mass and moisture of the measurement material with high local resolution is very easily possible, even at high sliver speeds. Measurement is independent of the sliver speed within the relevant speed range. Since mass calibration by microwave resonators is always linear, and, with the resonator empty, the microwave mass measurement value is equal to zero, a calibration of the mass measurement on material of constant moisture is possible by the plotting of a single calibration point. Two calibration points are necessary for calibrating the measurement of mass and moisture. After calibration, a moisture-compensated measurement of the sliver mass is ensured. Measurement is largely independent of the structure of the material, for example the crimping of the latter.

Measurements on cotton and synthetic fibres showed that a changing composition of the measurement material has only a slight effect on the measured values, that is to say the measurement error when a calibration-free material is used remains low.

What is claimed is:

1. A device for measuring the mass of a material strand running through a spinning preparation machine having a strand path, wherein the device comprises a microwave resonator and associated adapted measurement electronics, wherein said microwave resonator comprises two semi-cylindrical spaced-apart cavities between which is defined a slot-shaped orifice with an open end, said resonator operated at a resonant frequency selected to produce a measurement field in said slot-shaped orifice that is substantially homogeneous in a direction perpendicular to said strand path and said material can be introduced into said slot-shaped orifice from said open end and passes through said measurement field, said mass measurement being substantially unaffected by movement of said strand within the measurement field perpendicular to the strand path.

2. The device according to claim 1, comprising means for measuring the speed of said material strand running through, and wherein said speed and said mass measurements are used to determine a mass flow of said material strand.

3. The device according to claim 1, wherein said resonant frequency is between approximately 300 MHz to approximately 30 GHz.

4. The device according to claim 1, wherein said resonant frequency is between approximately 1 GHz to approximately 10 GHz.

5. A method for measuring the mass of a material running through a spinning preparation machine in a process direction, wherein the measurement is carried out with the aid of microwaves, said method comprising the steps of:

providing a microwave resonator including two semi-cylindrical spaced-apart cavities to define an open ended slot aligned with a path of said material;

operating said microwave resonator at a frequency selected to provide a measurement field in said slot that is substantially homogeneous in a direction perpendicular to said path;

introducing said material into said measurement field; and providing measurement electronics configured to detect changes to said measurement field attributable to the mass of said material, wherein said changes are substantially independent of the movement of said material within said measurement field perpendicular to the path of said material.

6. A The method according to claim 5, comprising the step of measuring the speed of the material running through the spinning preparation machine, and wherein said speed and said mass measurements are used to determine a mass flow of said material through said resonator.

7. The method according to claim 5, wherein the step of operating is carried out at microwave frequencies between approximately 300 MHz to approximately 30 GHz.

8. The method according to claim 5, wherein the step of operating is carried out at microwave frequencies between approximately 1 GHz to approximately 10 GHz.

9. A material spinning preparation machine comprising at least one microwave resonator and measurement electronics adapted for measuring the mass of the material running though the machine along a path in a process direction, wherein said microwave resonator comprises two semi-cylindrical spaced-apart cavities between which is defined a slot-shaped orifice with an open end, said resonator operated at a resonant frequency selected to produce a measurement field in said slot-shaped orifice that is substantially homogeneous in a direction perpendicular to said path and said material is introduced into said slot-shaped orifice to pass through said measurement field, said mass measurement being substantially unaffected by movement of said strand within the measurement field perpendicular to the path.

10. The spinning preparation machine according to claim 9, comprising carding means wherein said microwave resonator is located after said carding means.

11. The spinning preparation machine according to claim 9, comprising drawing means wherein said microwave resonator is located in said drawing means.

12. The spinning preparation machine according to claim 9, comprising a draw frame, wherein said microwave resonator is located downstream of said draw frame.

13. The spinning preparation machine according to claim 9, comprising at least one microwave resonator for measuring the moisture of said material.

* * * * *

UNITED STATES PATENT AND TRADEMARK OFFICE

CERTIFICATE OF CORRECTION

PATENT NO. : 6,837,122 B2
DATED : January 4, 2005
INVENTOR(S) : Herrmann et al.

It is certified that error appears in the above-identified patent and that said Letters Patent is hereby corrected as shown below:

Column 5,
Line 9, delete "can be" and substitute -- is --.
Line 11, delete "and passes" and substitute -- to pass --.
Line 37, after "field" insert -- through said slot open end --.

Column 6,
Line 26, after "orifice" insert -- from said open end --.

Signed and Sealed this

Fourth Day of April, 2006

JON W. DUDAS
*Director of the United States Patent and Trademark Office*